United States Patent [19]

Antal et al.

[11] Patent Number: 4,499,716

[45] Date of Patent: Feb. 19, 1985

[54] REINFORCEMENT STRUCTURE

[75] Inventors: Paul S. Antal; Manfred Katz, both of Wilmington, Del.

[73] Assignee: E. I. Du Pont De Nemours and Company, Wilmington, Del.

[21] Appl. No.: 503,656

[22] Filed: Jun. 13, 1983

[51] Int. Cl.[3] ..... D02G 3/36; D02G 3/38; D02G 3/40; D02G 3/48

[52] U.S. Cl. ..... 57/234; 57/210; 57/902

[58] Field of Search ..... 57/210, 229, 230, 232, 57/234, 902

[56] References Cited

U.S. PATENT DOCUMENTS

| | | | |
|---|---|---|---|
| 3,495,646 | 2/1970 | Marzocchi | 57/234 X |
| 3,556,922 | 1/1971 | Green et al. | 428/375 X |
| 3,644,866 | 2/1972 | Deardurff | 57/232 X |
| 4,269,024 | 5/1981 | Ashpole et al. | 57/234 X |
| 4,272,950 | 6/1981 | Bompard | 57/232 |
| 4,299,884 | 11/1981 | Payen | 57/234 X |
| 4,384,449 | 5/1983 | Byrnes, Sr. et al. | 57/210 |

FOREIGN PATENT DOCUMENTS

| | | |
|---|---|---|
| 3000273 | 7/1980 | Fed. Rep. of Germany . |
| 52-82974 | 7/1977 | Japan . |
| 19819 | 5/1981 | Japan . |
| 987401 | 3/1965 | United Kingdom . |
| 2048773A | 12/1980 | United Kingdom . |

*Primary Examiner*—John Petrakes

[57] ABSTRACT

Reinforcement structure with enhanced compressive strength is obtained by wrapping a yarn helically around a core of longitudinally aligned yarn to form a sheath that compresses the core, the yarn of both sheath and core having a tenacity greater than 10 dN/tex and an initial modulus greater than 200 dN/tex.

9 Claims, 4 Drawing Figures

REINFORCEMENT STRUCTURE

BACKGROUND OF THE INVENTION

A number of yarns available today have tenacities in excess of 10 decinewtons per tex (dN/tex). In this category one finds yarns of Kevlar® aramid fiber, glass fiber, carbon fiber, aromatic polyester fiber and fibers of certain other materials. It is believed that the compressive strengths of such yarns, and particularly of the aramid and aromatic polyester yarns, may have restricted their use as reinforcement in structural composite applications. An object of the present invention is to provide structures of such yarns wherein compressive strength is enhanced with minimal reduction in tensile strength.

SUMMARY OF THE INVENTION

This invention provides a reinforcement structure (sometimes briefly referred to hereinafter by the single word, "structure") consisting of a core surrounded by a sheath, said core being under at least 0.1% radial compression and comprising longitudinally aligned yarn and said sheath comprising a helical wrapping of yarn with adjacent turns of the helical wrapping abutting and being positioned at an angle to the core of between 80 and 90 degrees, the ratio of sheath thickness to the radius of the reinforcement structure being from 0.01 to 0.25, and the yarn of both sheath and core having a tenacity greater than 10 dN/tex and an initial modulus greater than 200 dN/tex. Preferably aramid fiber is used for both sheath and core yarns and still more preferably, at least the core yarn is embedded in a resin matrix.

DRAWINGS

FIGS. 1*a* and 1*b* are schematics of the reinforcement structure of the present invention.

FIGS. 2 and 3 are schematics of apparatus suitable for making the reinforcement structure.

DETAILED DESCRIPTION OF THE INVENTION

Figure 1A:
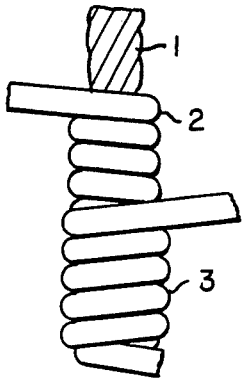

The reinforcement structure of this invention is made up of a core component and a sheath component, each constituted by one or more yarns which may be impregnated with a resin. The core yarns provide the tensile strength of the structure and hence should be selected from the group of high strength (tenacity greater than 10 dN/tex) yarns. It is also important that the modulus be high, greater than 200 dN/tex for reinforcement applications. Yarn of synthetic organic fiber such as aramid fiber is preferred for this purpose although inorganic fiber yarns from glass fiber or carbon fiber are also useful. As used herein, the term "yarn" includes both multifilamentary yarns and yarns made of staple fibers. Preferably the core yarn is untwisted or only slightly twisted and still more preferably is transformed into a solid rod in which the original fibers or filaments of the core yarn can no longer move with respect to one another. The solid rod may be formed by sintering and fusing the core yarn, with or without the addition of plasticizing agents. In another embodiment, the core yarn is embedded in a resin matrix. The resin should occupy less than about 75% by volume of the core and preferably less than 40% of the core volume. Any of a variety of resins may be used for impregnation of the yarn such as epoxy resins, unsaturated polyester resins and thermosplastic resins. Resins with low compressibility are preferred. A convenient method of embedment is by pultrusion techniques.

In the structure of the invention the axially compressed core must be radially restrained in order to reduce hysteresis losses when the reinforcement structure goes through compression-decompression cycles during use. In general, the greater this radial restraint, the more noticeable the improvement in axial compressive strength of the reinforcement structure. At least 0.1% radial compression and preferably at least 0.5% compression of the core has been found to give improved structures. It is best that the core be hard and essentially void-free in order to achieve the most efficient restraint and the highest compression strength for the structure.

The sheath component radially compresses and restrains the core and thus precludes lateral plastic flow and buckling when the reinforcement structure is subjected to high compression loads. In order to provide the necessary containment of the core, it is essential that the adjacent turns of the helical wrap be contiguous or abut. Also high tenacity, i.e. greater than 10 dN/tex, and high initial modulus, i.e. greater than 200 dN/tex, low creep yarn is required for the wrap so that it does not yield, relax, nor break as high axial compressive forces are applied to the core. Use of high tenacity i.e., greater than 10 dN/tex yarn for the wrap permits use of thinner sheaths to obtain high axial compressional strength for the reinforcement structure without undue reduction in tenacity. The wrap yarns are under tension while the core is under compression. For this reason it is important that the wrap yarns exhibit low tensile creep; i.e., the stress decay of the yarns should be low.

The class of resins useful for the core is also useful for the sheath or wrap yarns. The resin can function as an adhesive that contributes toward making a strong structure, keeps the wrap in place, and prevents unravelling. The resin should constitute no more than about 40% by volume of the sheath. A high helical wrap angle of between 80 and 90 degrees permits the fullest use of the wrap in providing radial compression.

It is desirable that the sheath not be too thick since it adds little or no tensile strength to the reinforcement structure and in fact reduces the tenacity of the reinforcement structure. Sheath thickness to reinforcement structure radius ratios of from 0.01 to 0.25 are useful. These measurements can be made under a microscope with a calibrated field.

Figure 1B:
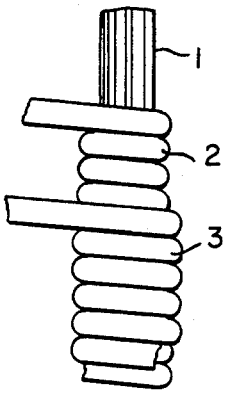

It will be noted in FIG. 1*a* that the yarns in the core portion 1 are longitudinally aligned with minimal twist (e.g., 0.1 turn per cm). Two wrap layers, 2 and 3 respectively, are shown in FIG. 1*a*. Each wrap layer surrounds the core in helical fashion. No space is left between the turns. The wrap angle is in the range of 80 to 90 degrees but preferably is as close to 90 degrees as possible. In FIG. 1*a* the wrap angles of layers 2 and 3 are in opposed directions. In FIG. 1*b* the wrap angles of the two layers 2 and 3 are in the same direction. In FIG. 1*b* the core yarn 1 is a zero-twist multifilamentary yarn.

Figure 2:
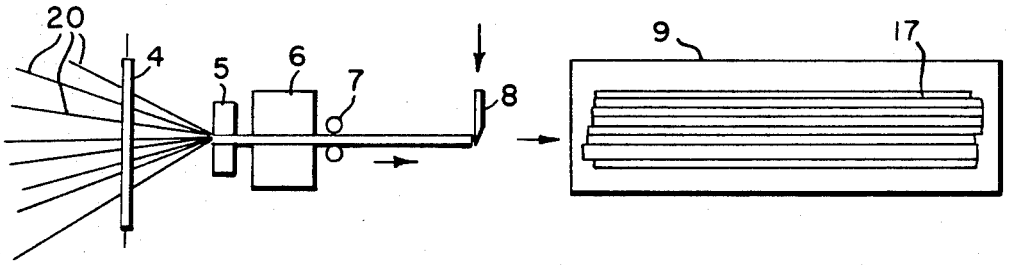
Figure 3:
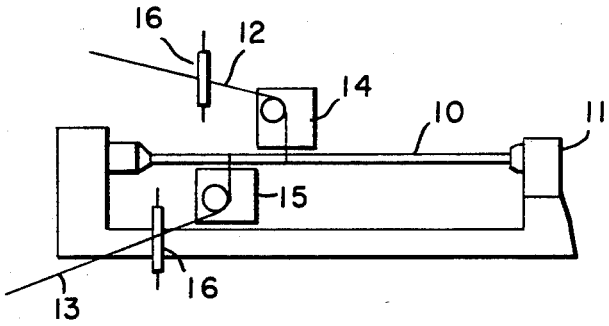

Preparation of the reinforcement structure with resin impregnated core will be readily understood by reference to FIGS. 2 and 3. The core portion is shown in FIG. 2 as prepared by a pultrusion technique. Yarn 20 from bobbins (not shown) is led past a tensioning device 4 and resin is applied. The tensioning device may be a comb through which the yarn passes or, preferably, multiple rolls with suitable brakes over which the yarn passes. Resin is preferably applied to the yarn after passage through the tensioning device and the yarn is then pulled through a die 5 which controls the amount of resin on the core portion and squeezes entrapped gas bubbles from the core portion. The yarn is then drawn through one or more curing ovens 6 by pulling rolls 7 and then cut by cutter 8 in any desired lengths. The resin matrix in the cut lengths is cured in the oven 9 thereby providing hard stiff rods 17 which will constitute the core portion for the reinforcement structure.

Resins suitable for application to the yarn in the preparation of pultruded rods are conventional resins which can be purchased for this purpose in already-mixed form ready for polymerization with the addition of catalyst. As an example of a resin suitable for application to the yarn in the pultrusion process described in the preceding paragraph, 4.0 g. of benzoyl peroxide may be added to 200 g. of the unsaturated polyester, poly[propylene maleate/isophthalate (50/50)-styrene (60-40)], manufactured by Freeman Chemical Corp., 222 E. Main St., Port Washington, Wis. 53074.

The pultruded rod 10 is mounted in the lathe 11 shown in FIG. 3. Yarns 12 and 13 are wrapped around the rod as the lathe rotates. Yarns 12 and 13 are fed from separate bobbins (not shown) through guides 16 to resin applicators 14 and 15 respectively which advance along the length of the pultruded rod and form two helical wraps around the rod as it turns in the lathe. The wrapping devices apply tension of at least about 0.05 dN/tex, preferably 0.5–15 dN/tex, to the wrapping yarn thereby compressing the core. The wrapped product is then passed through an oven (not shown) to cure the resin in the sheath.

The apparatus for making the reinforced structure can readily be modified to accommodate the wrapping of yarn, impregnated with resin or otherwise, with a yarn which also may or may not be resin-impregnated. The chucks of the lathe may be replaced by hooks and a length of yarn which will constitute the core of the reinforcement structure may be mounted under tension between the hooks. The wrapping yarn can be applied as described earlier. If desired, the yarn or pultruded rod used as the core may be wrapped with a single layer of wrapping yarn; or multiple layers of wrapping yarn may be wrapped upon the core one layer at a time, either in the same direction or in alternating directions.

TEST METHODS

Ultimate Compressive Strength

Compressive properties were determined on bars reinforced with the structure to be tested in general accordance with ASTM procedure D3410-75.

A mold with a lower member having a groove 30 cm (12 in) long (e.g., made up of two 15 cm (6 in) sections longitudinally aligned) and a rectangular cross section 0.64 cm (0.25 in) wide and 1.9 cm (0.75 in) deep and an upper male member which exactly fills the groove when the two members are brought together is used to make the reinforced bar. With upper member removed, the groove in the lower member is wetted with a heat-curable epoxy resin (Epon 826 made by Shell Chemical Co. and hardener). The structures to be tested are packed side-by-side as tightly as possible in the groove, and run the entire length of the groove to form a tight bottom layer. Thus, if the structures have a diameter in the range 0.11–0.125 cm (0.043–0.049 in), five are used in the bottom layer, while more samples of smaller diameter or fewer samples of large diameter may be required to form the bottom layer. Adding additional liquid resin as necessary to fill all voids, another layer of samples is placed side-by-side on top of the first. Further layers of samples are similarly laid side-by-side on top of the lower layers until the groove is filled with sample layers to a depth of 0.4 cm (0.156 in), while also adding more liquid resin as necesary to a depth of at least 0.4 cm. Shims 0.40 cm thick are then placed on either side of the groove in the lower member, and the mold is then closed by fitting the upper member into the lower with the shims interposed between the two members. The closed mold is then placed in a 90° C. oven for three hours and then in a 150°–155° C. oven for eighteen hours. The cured reinforced bar is removed when the mold has cooled to room temperature. A 14 cm (5.5 in) length of the bar is sawed off, making a square cut, for determination of ultimate compressive strength. The remainder of the bar is saved for other tests.

If the structure to be tested is fully impregnated with epoxy resin and cured, samples thereof may be packed directly in the groove as previously described. When the structure to be tested is a wrapped yarn in which the core yarn has been impregnated with liquid epoxy resin but the wrapping yarn has not, samples of the structure are first dipped in the liquid epoxy resin to wet them with the resin. The samples, wet with the resin, are then placed in the groove as before.

When the structure to be tested is an unimpregnated, wrapped yarn, the samples thereof are first dried in a 90° C. vacuum oven. The samples are then impregnated with liquid epoxy resin by placing them in a container, adding enough liquid resin to immerse the samples completely, placing the open container in a vacuum desiccator, evacuating the desiccator to about 73 cm (29 in) of mercury, and holding it under vacuum for one hour. The desiccator is then brought to atmospheric pressure with nitrogen and the samples are permitted to soak in the liquid resin under the nitrogen atmosphere for 3 more hours. The samples, wet with the liquid resin, are then placed lengthwise in the groove in the lower member of the mold and a reinforced bar is made according to the procedure already described.

Ultimate compressive strength values as reported in the examples were determined by testing the reinforced bars in accordance with ASTM procedure D3410-75, except that tabs were not bonded to the ends of the bars when they were tested and gauge lengths other than 12.70 mm (0.5 in) were sometimes used. The actual gauge length employed is reported when it is other than 12.70 mm. The ultimate compressive strength, S, is calculated in accordance with the ASTM procedure and the results reported in megapascals, MPa (or thousands of pounds per square inch, Kpsi).

Alternative Test For Compressive Strength

Cured, impregnated structures of relatively large diameter, e.g., on the order of 4 mm and above, were prepared for compression testing by cutting the structures at right angles with a diamond saw to make samples about 25 mm (1 in) long or less, but not longer than 3× the wrapped diameter. A metal ring or stack of washers 2–6 mm high, is placed over both ends of each sample to be tested and bonded thereto with an aluminum/epoxy high-modulus glue. In this step, special care is taken to assure alignment of the test section to the base plane (90°±0.5°) which is to be maintained when mounting the sample between the platens of the testing machine. The inside diameter of the ring or washers should be about equal to the diameter of the sample. After the sample has been mounted in the testing machine, the actual testing and calculation of results is performed in the same manner described in the above test method for Ultimate Compressive Strength.

Core Radial Compression

The structure to be examined must first be prepared in such a way that both the sheath and the core will remain intact with unchanged diameters when the structure is sectioned, and further so that the core will remain intact when the sheath surrounding it is then removed. A reinforced bar prepared by the method described under the Ultimate Compressive Strength test is satisfactory for this test. Impregnated and cured structures may be used directly. Previously unimpregnated structures must be impregnated and cured before testing.

If the sample to be examined is in the form of a reinforced bar, two consecutive 5 mm wafers of the bar are cut normal to the core axis of the embedded structures, using a low-speed wafering saw having a 10 cm diameter wafering blade (such as an "Isomet" 11-1180 wafering saw, manufactured by Buehler Ltd., 2120 Greenwood St., Evanston, Ill. 60204). The newly exposed surfaces are examined to determine whether the embedded structures are thoroughly impregnated with resin. If not, additional cuts are made until wafers are found in which the embedded structures are thoroughly impregnated. If suitable wafers cannot be located, an additional portion of resin mixture is infused from the cut end of the reinforced bar, the resin is cured, and new wafers are made.

The two faces (one the mirror image of the other) created by the cut dividing the two consecutive wafers are identified as faces A and B. Two matching structures from each face are selected and suitably marked or identified, e.g. by marking with red and black ink. Cross-sectional diameter directions at right angles are established and suitably designated for identification, e.g. as North-South and East-West.

The two selected structures from face B are removed by dissection and the shells (outer wrappings) are removed. The remaining cores are conditioned by placing them in an oven at 100° C. for one hour.

A small portion of a resin mixture is then placed in a sample cup and allowed to stand until the resin mixture becomes quite viscous. The resin mixture consisted of 2 parts by weight of a resin (Marglass®) and 1 part by weight of a hardener (Hardener #558), products of Acme Chemical & Insulation Co., a division of Allied Products Corp. Other resins can be used. The conditioned, unwrapped cores from face B are then placed in the viscous resin in the sample cup side-by-side with the wafer containing face A, arranging the samples so that the axes of the cores are all substantially parallel and normal to the base. More of the resin mixture is then poured into the cup, fully immersing the wafer containing face A and the unwrapped cores from face B and the cup is placed in the oven for a time sufficient to harden the embedding medium. The embedded sample is then separated from the cup and polished by hand on a metallographic polisher/grinder table using 400 and then 600 grit silicon carbide grinding papers then 6 micrometers, 3 micrometers, and finally 1 micrometer diamond paste.

The polished sample is then placed on a stereo microscope equipped with a calibrated image-shearing eyepiece situated in the phototube of the microscope. At a magnification of about 36×, the diameters of the cores are measured to the nearest 0.05 mm or better. The image-shearing eyepiece is previously calibrated by shearing the image of a ruled micrometer slide graduated at 0.1 mm intervals. For each core diameter measurement the image-shearing eyepiece is adjusted so that the core images are precisely side-by-side. For the wrapped yarn samples, the image-shearing eyepiece is adjusted so that the shells overlap, with the core images (the images of the outer periphery of the core cross section) being precisely side-by-side, and the core diameters are measured. Each measurement is repeated five times. The sample is then rotated 90° and the measurement is again repeated five times. The North-South and East-West measurements are then averaged and mean and standard deviations are calculated. The diameter measurements of the unwrapped cores, designed $D_u$, are taken as a measure of the unstressed diameters of the cores. The diameter measurements of the cores of the wrapped yarn samples, designated $D_s$, are taken as a measure of the stressed diameter of the cores. Core Radial Compression, $C_{rc}$, is then calculated from the equation $$C_{rc} = \frac{D_u - D_s}{D_u} \times 100\%$$

If the composite yarn structures to be examined are impregnated individual yarn samples rather than resin-matrix composite bars reinforced by composite yarn structures, essentially the same procedure described above is used. Two or more pairs of wafers with mirror-image faces are prepared, making sure that the exposed embedded structures are thoroughly impregnated with cured resin.

Short-Beam Shear-Strength

Samples of the reinforcement structure are tested for short-beam shear-strength in accordance with ASTM procedure D-2344-76.

In the examples that follow the sheath yarns were wrapped around the core at an angle to the core of between 80 and 90 degrees and in the form of a helix with adjacent turns abutting. The E-glass employed had a tenacity of 13.5 dN/tex and a modulus of 282 dN/tex. The S-2 glass yarn had a tenacity of about 17.5 dN/tex, and a modulus of about 335 dN/tex.

EXAMPLE 1

A. Quantities of commercially available 5000-filament 789-tex (7100 denier), and 267-filament, 42-tex (380-denier), poly(p-phenylene terephthalamide) yarns having substantially zero twist were obtained having tenacities of about 19.7 dN/tex, elongations of about 2.28%, and initial moduli of about 843 dN/tex. An approximately 46-cm (18-in) length of the 5000-filament yarn with a loop tied into each end was used as the core yarn. The core yarn was dried in a 90° C. vacuum oven and impregnated with liquid heat curable epoxy resin (a mixture of 100 g Epon 826 resin, 1.5 g benzyldimethylamine, and 90 g nadic methyl anhydride as hardener).

The loops of the core yarn were placed over hooks attached to the driven chucks of a lathe ("South Bend" Precision Lathe Model A, manufactured by South Bend Lathe Works, South Bend, Ind.) modified for the work reported in this example so that both ends were rotating at the same speed. The movable right hand chuck was then adjusted so that the core yarn was very taut in order to minimize false twisting of the core yarn during wrapping. The core yarn was then wrapped with one layer of the 267-filament yarn which had been twisted to 2.2 turns per cm. The wrapping tension was 2150 g (4.9 dN/tex or 5.5 gpd tension), and the 267-filament yarn was wrapped at 44 turns per cm (112 turns per inch) at an angle of almost 90° to the axis of the core yarn. The tension of wrap yarn was controlled by passing the yarn around electro-mechanical brake rolls. The wrap yarn was tied around the core yarn at each end to prevent unraveling. The product, a core yarn impregnated with epoxy resin and surrounded by a sheath of a single layer of wrap yarn, is designated as Structure 1A. The core contained about 4.7% by wt. of resin. This structure had a sheath thickness of 0.111 mm and a radius of 0.529 giving a sheath thickness to reinforcement structure radius of 0.21. Twenty samples of Structure 1A were dipped in liquid epoxy resin to wet them with the resin and were then made into a reinforced bar, following the procedure described above in the test method for "Ultimate Compressive Strength". The twenty samples were placed in the grooves in four layers, each layer having five samples laid side-by-side. The cured bar, when tested at 1.59 cm (0.625 in) gauge length according to the designated procedure, had an Ultimate Compressive Strength of 432 MPa (62.6 Kpsi).

A control consisting of an unwrapped sample of the core yarn used to make Structure 1A, when impregnated with the same resin and cured, had an Ultimate Compressive Strength of only 234 MPa (33.9 Kpsi).

B. Part A above was repeated, except that the core yarn which had been impregnated with liquid epoxy resin was wrapped with two layers of the 267-filament yarn which had been twisted to 2.2 turns per cm at a wrapping tension of 1600 g (7.2 dN/tex or 8.2 gpd tension). The second layer of wrap was started at the same end as the first but wrapped in the opposite direction. The product, a core yarn impregnated with liquid epoxy resin and surrounded by a sheath of two layers of wrap yarn, is designated as Structure 1B. The core contained about 5% by wt. of resin. This structure had a sheath thickness of 0.108 and a ratio of sheath thickness to reinforcement structure radius of 0.205. A resin-matrix bar reinforced with twenty samples of Structure 1B was made. The cured bar, when tested at 1.59 cm (0.625 in) gauge length, had an Ultimate Compressive Strength of 434 MPa (62.9 Kpsi).

C. Part A was repeated, wrapping the same core yarn with one layer of the same wrapping yarn, except that the core yarn was not dried and impregnated with liquid epoxy resin prior to wrapping, and the wrapping tension was 3250 g (7.5 dN/tex or 8.5 gpd tension). The 267-filament yarn was wrapped at 44 turns per cm. (112 turns per inch) around the core as in Part A. The product, a core yarn containing no liquid epoxy resin and surrounded by a sheath of one layer of wrap yarn, is designated as Structure 1C.

Twenty samples of structure 1C are then impregnated with liquid epoxy resin, using the procedure for unimpregnated, wrapped yarn described in the test method for Ultimate Compressive Strength. A resin-matrix bar reinforced with the twenty resin-impregnated samples of Structure 1C was made. The cured bar, when tested at 0.635 cm (0.25 in) gauge length, had an Ultimate Compressive Strength of 433 MPa (62.8 Kpsi).

D. Core radial compression values were determined for Structures 1A, 1B, and 1C. The diameters of the unwrapped cores, $D_u$, were 0.925 mm for Structure 1A and 0.910 mm for Structure 1B. The average of these two values, 0.918 mm when rounded to three decimal places, was used as the value for $D_u$ for all three samples. The core radial compression values, $C_{rc}$, are given in the table below for all three samples.

| | $D_u$ | $D_s$ | $C_{cr}$ |
|---|---|---|---|
| Structure 1A | 0.918 mm | 0.866 mm | 5.7% |
| Structure 1B | 0.918 | 0.883 | 3.8 |
| Structure 1C | 0.918 | 0.87 | 5.2 |

EXAMPLE 2

A commercially pultruded E-glass/unsaturated polyester composite rod containing about 40% by wt. of resin (McMaster-Carr Corp. 8548, K-15, 9.47±0.03 mm diameter rod) was tension wrapped with five layers of 333 tex (3000 denier) S-2 glass yarn, impregnated with an epoxy resin mix (10 parts of Epon 826 resin and 4 parts of V-40 hardener both manufactured by Shell Chemical Co.)

Using the lathe of Example 1 and using only one feed yarn bobbin, a first wrap layer was applied at a tension of 10 Kg with a wrap yarn spacing of 0.8 mm (corresponding to a pitch of 1/32 in). Four more wrap yarn layers at the same spacing were applied successively at tensions of 9.5, 9.0, 8.5, and 8.0 Kg, respectively. The wrapped structure was cured for 2 hours at room temperature and 2 hours at 80° C. Its overall diameter was 11.3 mm with sheath thickness of 1 mm giving a sheath thickness to reinforcement structure radius of 0.18. The reinforcement structure had an Ultimate Compressive Strength of 621.6 MPa (90.16 Kpsi). The commercially pultruded fiberglass/polyester composite rod used as a starting material had an ultimate compressive strength of only 345 MPa (50 Kpsi).

In the test for Core Radial Compression, the wrapped core had a diameter of 9.30 mm ($D_s$) and the unwrapped core had a diameter of 9.48 mm ($D_u$). The Core Radial Compression was therefore calculated as 1.9%.

EXAMPLE 3

A commercially pultruded poly(p-phenylene terephthalamide) filament/epoxy resin composite rod containing about 35% by wt. of resin was tension wrapped as in Example 2 with five layers of 333 tex (3000 denier) S-2 glass yarn, impregnated with the same epoxy resin mix employed in Example 2, and cured. The filaments in the pultruded rod had the same physical properties as the filaments in the yarns employed in Example 1.

The reinforcement structure had an overall diameter of 11.6 mm, with a core diameter of 9.6 mm. It had an ultimate compressive strength of 427.5 MPa (62.0 Kpsi), while the commercially pultruded composite rod used as a starting material had an ultimate compressive strength of only 241.3 MPa (35.0 Kpsi).

In the test for Core Radial Compression, the wrapped core had a diameter of 9.65 mm ($D_s$) and the unwrapped core had a diameter of 9.79 mm ($D_u$). The Core Radial Compression was therefore calculated as 1.43%.

EXAMPLE 4

A 45 cm (18 in) long, 3330 tex (30,000 denier) core yarn of S-2 glass fibers was formed from 5 loops of a 333 tex (3000 denier) yarn of the glass fibers. The 45 cm core yarn was impregnated with a mixture of Epon 826 resin and diethylenetriamine in a ratio of 10:1 parts by weight. Following the procedure of Example 1, the resin-impregnated core yarn containing about 25% by wt. of resin was then wrapped with four layers of a resin impregnated 42 tex (380 denier) poly(p-phenylene terephthalamide) yarn having a tenacity of 23.0 dN/tex (26.1 gpd), an elongation of 3.42%, and an initial modulus of 625 dN/tex (708 gpd), measured at a 25.4 cm (10 in) gauge length after the wrapping yarn was twisted to a twist multiple of 1.1. The wrapping tension was 6000 g for each of the four layers, and the yarn was wrapped at 44 turns per cm (112 turns per inch) at an angle of almost 90° to the axis of the core yarn. The same liquid resin used to impregnate the core yarn was applied to the wrapping yarn just prior to the wrapping operation. The wrapped structure was cured for 2 hours at room temperature and two hours at 80° C. The resulting reinforcement structure had an overall diameter of 4.3 mm, and its core diameter was 3.7 mm. It had an ultimate compressive strength of 735 MPa (106.6 Kpsi). A sample of the reinforcement structure was unwrapped; the unwrapped core had an ultimate compressive strength of only 343 MPa (49.7 Kpsi).

In the test for Core Radial Compression, the wrapped core had a diameter of 3.475 mm ($D_s$) and the unwrapped core had a diameter of 3.675 mm ($D_u$). The Core Radial Compression was therefore calculated as 5.4%.

The short-beam shear-strength of the reinforcement structure was found to be 104 MPa (15.11 Kpsi), as compared to only 56.5 MPa (8.2 Kpsi) for an identically prepared specimen, unwrapped before testing.

EXAMPLE 5

A commercially pultruded poly(p-phenylene terephthalamide) filament/isophthalic polyester composite rod containing about 35% by wt. of resin was tension wrapped as in Example 2 with eight layers of poly(p-phenylene terephthalamide) filamentary yarn impregnated with an epoxy resin mix. The pultruded rod was 164 mm (6.45 in) long, had a diameter of 7.95 mm (0.3125 in), and contained about 65%±5% by volume of the poly(p-phenylene terephthalamide) filaments having a tenacity of about 19.7 dN/tex, an elongation of 2.28%, and an initial modulus of about 843 dN/tex. The wrapping yarn, originally a 267-filament, 42 tex (380-denier) poly(p-phenylene terephthalamide) yarn, was twisted at 1.1 twist multiplier to a final linear density of 45 tex (405 denier). When impregnated with the epoxy resin mix of Example 4 and cured, it has a 25.4 cm (10 in) gauge strand tenacity of 20.2 dN/tex (22.9 gpd), with a initial modulus of 725 dN/tex (821 gpd) and an ultimate tensile strain of 2.74%.

Using the lathe as shown in FIG. 3, except that only one feed bobbin was used, a first wrap layer was applied at a tension of 6.5 kg, the epoxy resin mix of Example 4 being applied to the yarn just before it was wrapped around the rod. The yarn was wrapped from left to right at a spacing of 4.41 wraps per mm, covering 136 mm of the length of the rod before tying off the wrapping yarn. Three more layers were then wrapped in the same direction at the same tension and spacing. A fifth and sixth layer were applied at a tension of 5.5 kg, a seventh layer at 4 kg tension, and an eighth layer at 3 kg tension. The wrapped structure was cured for 2 hours at room temperature and 2 hours at 80° C. The overall diameter of the resulting reinforcement structure was 9.52 mm. It had an ultimate compressive strength of 881 MPa (127.8 Kpsi), determined by the Alternative Test for Compressive Strength. The commercially pultruded composite rod used as a starting material had an ultimate compressive strength of only 203 MPa (29.4 Kpsi).

A 3.9 mm thick slice was cut from the reinforcement structure, normal to its axis, with a diamond wafering blade. The shell was split from the core with a sharp razor blade and both pieces were conditioned one hour at 100° C. The core diameter, $D_u$, was measured with a precision caliper and found to be 7.955±0.05 mm. The stressed diameter of the core, $D_s$, was similarly measured and found to be 7.820±0.01 mm. The core radial compression was then calculated as 1.7%.

EXAMPLE 6

Twelve 45 cm (18 in) loops of poly(p-phenylene terephthalamide) 157.8 tex (1420 denier) yarn having a tenacity of about 19.7 dN/tex, elongation 2.28% and modulus 845 dN/tex were impregnated with epoxy resin as described in earlier examples (33% by wt. of resin) and were wrapped with 3 layers of 42 tex (380 denier) poly(p-phenylene terephthalamide) 1.1 twist multiplier yarn having a tenacity of 23.0 dN/tex an elongation of 3.42% and a modulus of 625 dN/tex. The wrapping yarn was impregnated with the epoxy mix described in Example 4 and the core was wrapped in accordance with the earlier described procedures.

Tension on the 3783 tex (34,080 denier) core was about 32 kg, while 2 kg tension was applied to the wrapping yarn. Individual wrap-layers were heated for short periods with hot air from a heat gun, and the reinforcement composite was cured for 72 hours at 100° C. The core was under 1% radial compression and the reinforcement structure had a ratio of sheath thickness to radius of the structure of 0.17, the sheath being 0.20 mm thick.

The overall compression strength was 779 MPa (113 Kpsi) vs. 241 MPa (35 Kpsi) for the pultruded control.

Thermal Mechanical Analysis (using a Du Pont 943 Thermal Mechanical Analyzer) showed a very low axial coefficient of thermal expansion, ±0.4 ppm/°C. for the temperature range 30°-100° C., compared to −3.5 ppm/°C. for unwrapped control. Poly(p-phenylene terephthalamide is known to have a negative thermal coefficient of expansion. Thus, pressurizing the uniaxial composite with tensioned wraps permits control of axial coefficient of thermal expansion to less than 1 part per million over the temperature range of 30° to 100° C., a property that is very desirable for precision aero-space structures.

We claim:

1. A reinforcement structure consisting of a core surrounded by a sheath, said core being under at least 0.1% radial compression and comprising longitudinally aligned yarn and said sheath comprising a helical wrapping of yarn with adjacent turns of the helical wrapping abutting and being positioned at an angle to the core of between 80 and 90 degrees, the ratio of sheath thickness to the radius of the reinforcement structure being from 0.01 to 0.25, and the yarn of both sheath and core having a tenacity greater than 10 dN/tex, and an initial modulus greater than 200 dN/tex.

2. The reinforcement structure of claim 1 wherein the core contains a resin which occupies less than 75% of the core volume.

3. The reinforcement structure of claim 2 wherein the resin occupies less than 40% of the core volume.

4. The reinforcement structure of claim 1 wherein the core and sheath yarns are of organic fiber.

5. The reinforcement structure of claim 4 wherein the organic fiber is an aramid.

6. The reinforcement structure of claim 1 wherein the core and/or sheath yarns are of inorganic fiber.

7. The reinforcement structure of claim 1 wherein the core is under at least 0.5% radial compression.

8. The reinforcement structure of claim 1 wherein both the core and the sheath yarns are impregnated with resin.

9. The reinforcement structure of claim 1 having an axial coefficient of thermal expansion of less than 1 part per million within the temperature range of 30° to 100° C.

* * * * *